US011771242B2

(12) United States Patent
Santarelli

(10) Patent No.: US 11,771,242 B2
(45) Date of Patent: Oct. 3, 2023

(54) CASH WRAP GREETING CARD DISPLAY

(71) Applicant: American Greetings Corporation, Cleveland, OH (US)

(72) Inventor: Anthony Santarelli, North Olmsted, OH (US)

( * ) Notice: Subject to any disclaimer, the term of this patent is extended or adjusted under 35 U.S.C. 154(b) by 279 days.

(21) Appl. No.: 17/375,901

(22) Filed: Jul. 14, 2021

(65) Prior Publication Data

US 2021/0340854 A1 Nov. 4, 2021

Related U.S. Application Data

(62) Division of application No. 16/993,665, filed on Aug. 14, 2020, now Pat. No. 11,559,149.

(60) Provisional application No. 62/887,839, filed on Aug. 16, 2019.

(51) Int. Cl.

| | |
|---|---|
| ***A47F 7/14*** | (2006.01) |
| ***A47F 5/01*** | (2006.01) |
| ***A47F 5/00*** | (2006.01) |

(52) U.S. Cl.

CPC ..... *A47F 7/145* (2013.01); *A47F 5/0031* (2013.01); *A47F 5/01* (2013.01); *A47F 7/148* (2013.01)

(58) Field of Classification Search

CPC .... A47F 7/145; A47F 5/01; A47F 5/08; A47F 5/00; A47F 5/0031; A47F 5/0056; A47F 5/13; A47F 7/146; A47F 5/0037; A47F 5/02; A47F 7/148; A47B 47/027; A47B 55/02

USPC ... 211/106, 50, 181.1, 49.1, 55, 41.1, 41.12, 211/112, 52

See application file for complete search history.

(56) References Cited

U.S. PATENT DOCUMENTS

| | | | | | |
|---|---|---|---|---|---|
| 996,421 | A * | 6/1911 | McCausland | B42F 17/02 | 211/181.1 |
| 1,715,078 | A * | 5/1929 | Whyte | A47F 7/148 | 40/124 |
| D93,944 | S * | 11/1934 | Schimmelfeng | 211/106 | |
| 2,167,375 | A * | 7/1939 | Rubenstein | A47F 7/148 | 211/50 |
| 2,698,690 | A * | 1/1955 | Rubenstein | A47F 7/148 | 211/106 |
| 2,743,020 | A | 4/1956 | Rubenstein | | |
| 2,944,679 | A * | 7/1960 | Rubenstein | A47F 5/01 | D6/678.4 |
| 4,140,221 | A * | 2/1979 | Garland | A47F 7/148 | 211/184 |
| 4,248,352 | A * | 2/1981 | White | A47F 5/0823 | 211/88.01 |
| 4,498,592 | A * | 2/1985 | Colucci | A47F 7/148 | 211/48 |
| 6,412,647 | B1 * | 7/2002 | Ko | A47B 87/0215 | 211/90.03 |
| D473,073 | S * | 4/2003 | Kettering | D6/572 | |
| 9,833,067 | B2 | 12/2017 | Good et al. | | |

FOREIGN PATENT DOCUMENTS

| | | |
|---|---|---|
| WO | 2017032465 | 3/2017 |

* cited by examiner

*Primary Examiner* — Hiwot E Tefera
(74) *Attorney, Agent, or Firm* — Christine Flanagan

(57) ABSTRACT

The present invention provides a flexible greeting card display assembly. The display includes a plurality of adjacent card pockets and flexible attachment plate which allows the display to be attached to various surfaces within a retail environment.

3 Claims, 6 Drawing Sheets

CASH WRAP GREETING CARD DISPLAY

RELATED APPLICATIONS

This application is a divisional of and claims priority to U.S. patent application Ser. No. 16/993,655, filed on Aug. 14, 2020, which is a non-provisional of U.S. Provisional Patent Application No. 62/887,839, filed on Aug. 16, 2019. The present application claims priority to the above-referenced patent applications, a copy of which is incorporated herein by reference.

FIELD OF THE INVENTION

The present invention is in the field of retail fixtures. More specifically, the present invention is directed to a greeting card display which can be attached to a variety of backing materials and placed at various locations in a retail environment.

SUMMARY OF THE INVENTION

The present invention provides a flexible greeting card display assembly. The display includes a plurality of card pockets and flexible attachment plate which allows the display to be attached to various surfaces within a retail environment.

DETAILED DESCRIPTION OF PREFERRED AND ALTERNATE EMBODIMENTS

Figure 1:
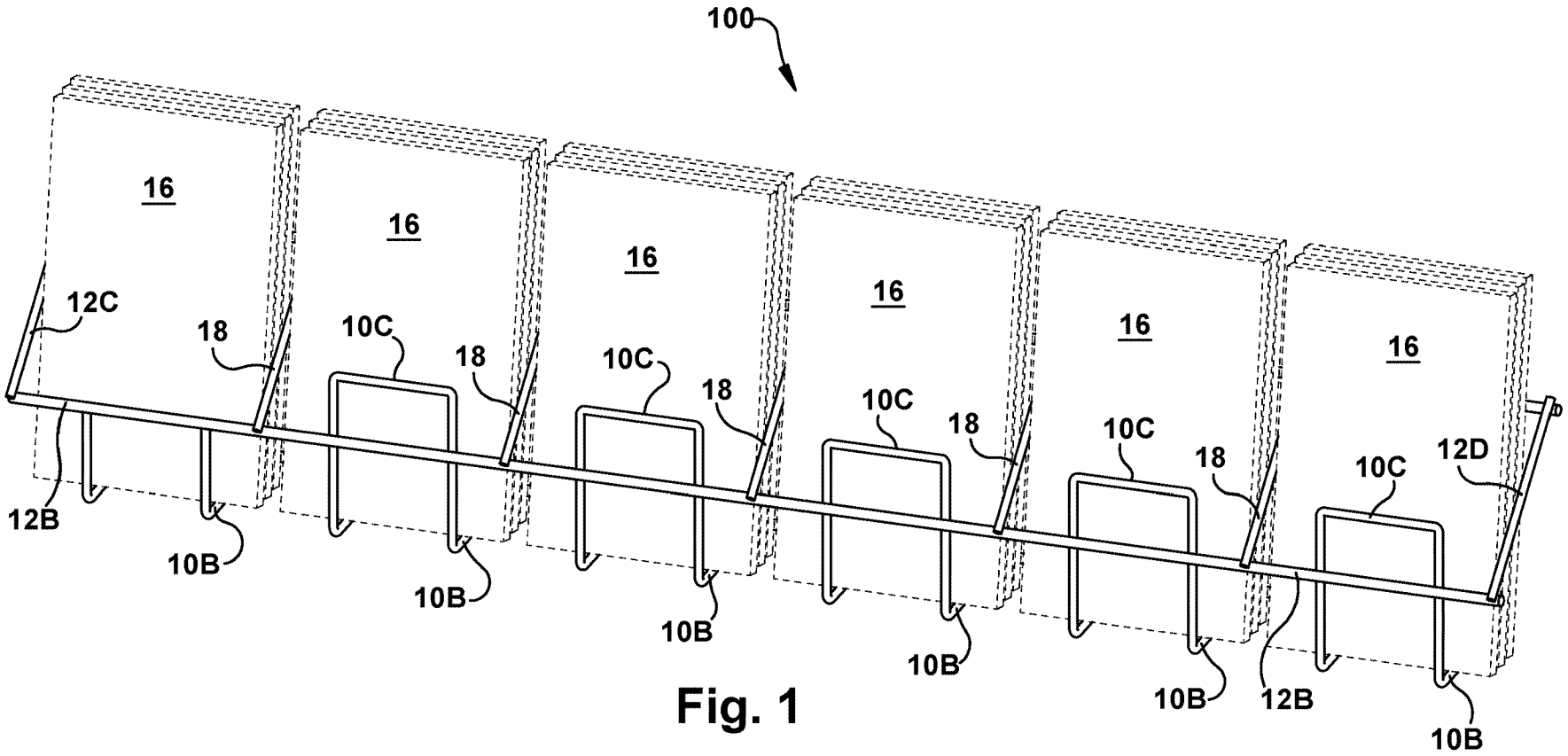
FIG. 1 is a perspective view of a first embodiment of the greeting card display assembly of the present invention, with greeting cards contained therein.

The present disclosure and related inventions describe a greeting card display assembly 100. This greeting card display assembly 100 is flexible in that it can attach to various backing materials and it can be placed at various locations within a retail environment, such as, for example, at the cash wrap where many impulse purchases are made.

In one embodiment, the greeting card display assembly 100 of the present disclosure and related inventions is a steel wire-formed construction providing a single row of greeting card pockets 10. A plurality of wire-formed pockets 10 are arranged in a horizontal manner and attached to a substantially rectangular wire frame 12 and a horizontal wire support or spine 14 which runs the length of the horizontally arranged card pockets 10. The horizontal wire support or spine 14 includes 2 parallel, spaced apart horizontal wires 14A, 14B which run the length of the plurality of wire-formed pockets 10.

In a first embodiment, as shown in FIGS. 1 through 7, the greeting card display assembly 100 is a horizontally arranged wire formed pockets 10 include an inverted u-shaped back portion 10A which serves as the back of the greeting card pocket 10, two parallel center wires 10B which extend perpendicular to and outward from the back portion 10A and serve as the bottom or floor of the greeting card pocket 20, and an inverted u-shaped front portion 10C which is perpendicular to and extends upward from the two parallel center wires 10B and parallel to the back portion 10A, that serves as the front of the greeting card pocket 10. The inverted u-shaped front portion 10C is shorter than the inverted u-shaped back portion 10A so that the front face of the greeting cards 16 placed into the pockets 10 are visible. The open design of the wire-formed greeting card display 100 maximizes product visibility.

The substantially rectangular wire frame 12 contains two horizontally positioned long 12A, 12B sides which are parallel to each other, and two vertically arranged short sides 12C, 12D which are parallel to each other and perpendicular to and extend between the two horizontally positioned long sides 12A, 12B. One of the two horizontally positioned long sides 12B is attached to a front surface of the front portion of the plurality of greeting card pockets 10. The other of the two horizontally positioned long sides 12A is attached to a rear surface of the back portion of the plurality of greeting card pockets 10. The two short sides 12C, 12D of the substantially rectangular wire frame 12 serve as the two opposing sides of the greeting card display assembly 100.

A plurality of divider wires 18 are located between each pair of adjacent greeting card pockets 10. The plurality of divider wires 18 are attached at one end to one of the horizontally positioned long sides 12A of the wire frame 12 and at an opposite end to the other of the horizontally positioned long sides 12B of the wire frame 12. The divider wires 18 serve to separate the card pockets 10.

In one embodiment, as shown in FIGS. 1 through 7, the greeting card display assembly 100 is approximately 36-inches wide, having 6 individual fixed-width pockets 10 and 5 divider wires 18. The back portion 10A of each greeting card pocket 10 is approximately 5-inches tall, with the front portion 10C being approximately 3.5-inches tall. As mentioned above, the front portion 10C is smaller than the back portion 10C so that the consumer can see more of the front face of the greeting cards 16 placed into the pocket 10. The length of the two parallel center wires 10B, which serve as the bottom or floor of each greeting card pocket 10, is approximately 1.5-inches wide. The bottom or floor 10B of each greeting card pocket 10 is positioned in a forward slanted or sloping configuration, creating an angle between the bottom or floor 10C and the back portion 10A of each greeting card pocket 10 of approximately 115.6-degrees. The angle allows the greeting cards 16 placed into the pockets 10 to lie in a slightly backward tilted position which helps retain the cards 16 within the pocket 10. While specific pocket 10 and divider 18 numbers and measurements have been given to describe the embodiment of the greeting card display assembly 100 shown in the figures, the greeting card display assembly 100 can be manufactured with less than 6 or greater than 6 pockets and the greeting card pockets 10 may be smaller or larger, depending on retail need.

Figure 2:
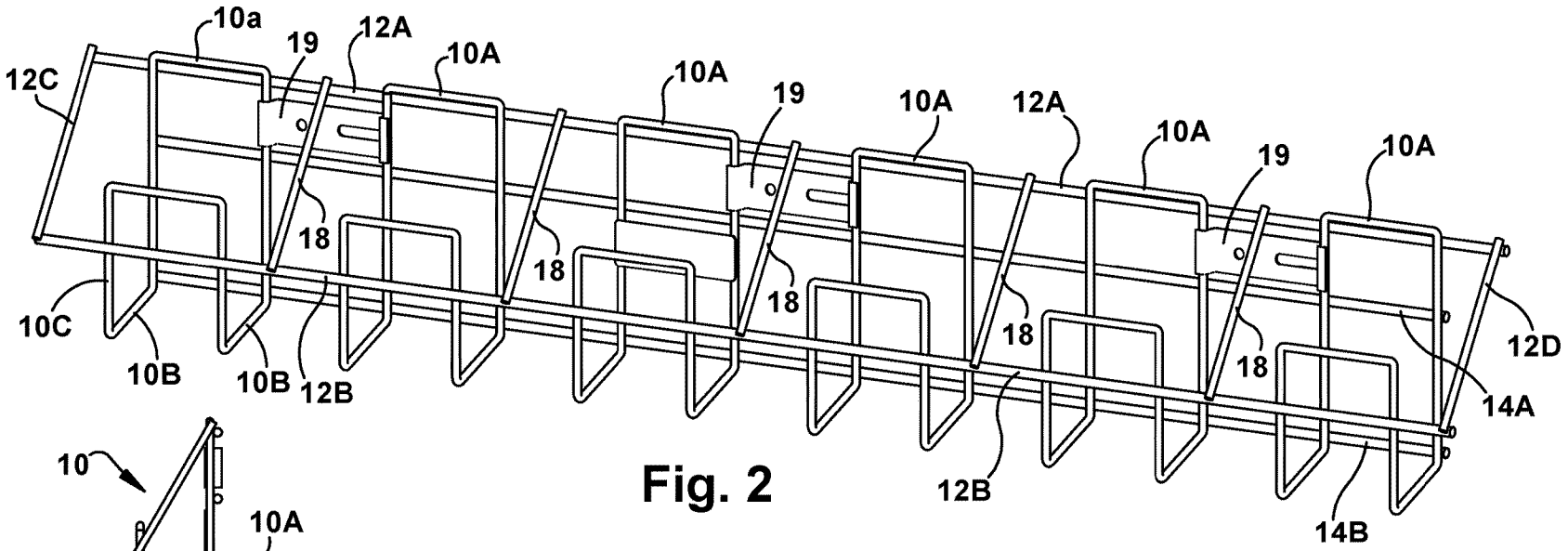
FIG. 2 is a perspective view of the greeting card display assembly of FIG. 1, without greeting cards.
Figure 3:
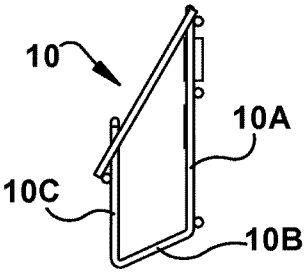
FIG. 3 is a right side view of the greeting card display assembly of FIG. 2.
Figure 4:
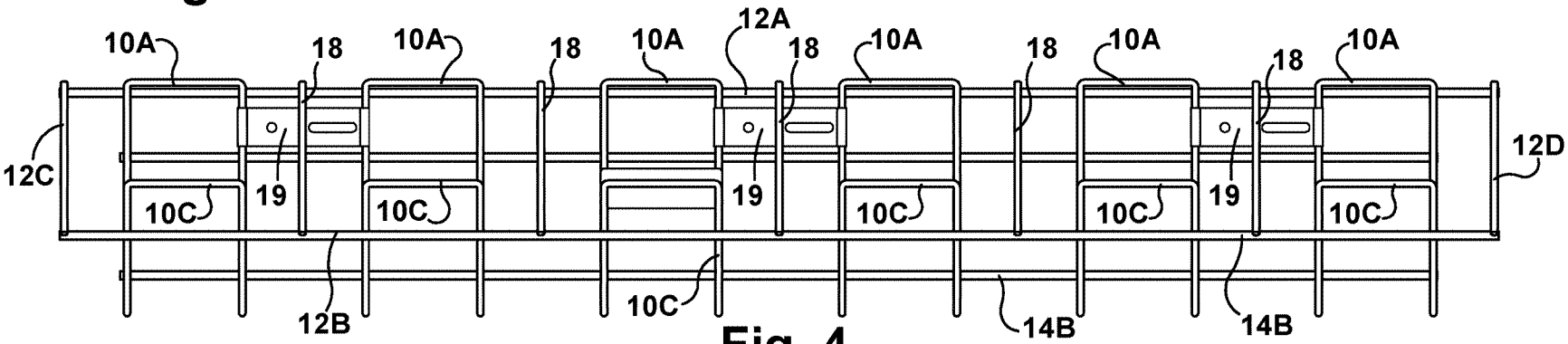
FIG. 4 is a front view of the greeting card display assembly of FIG. 2.
Figure 5:
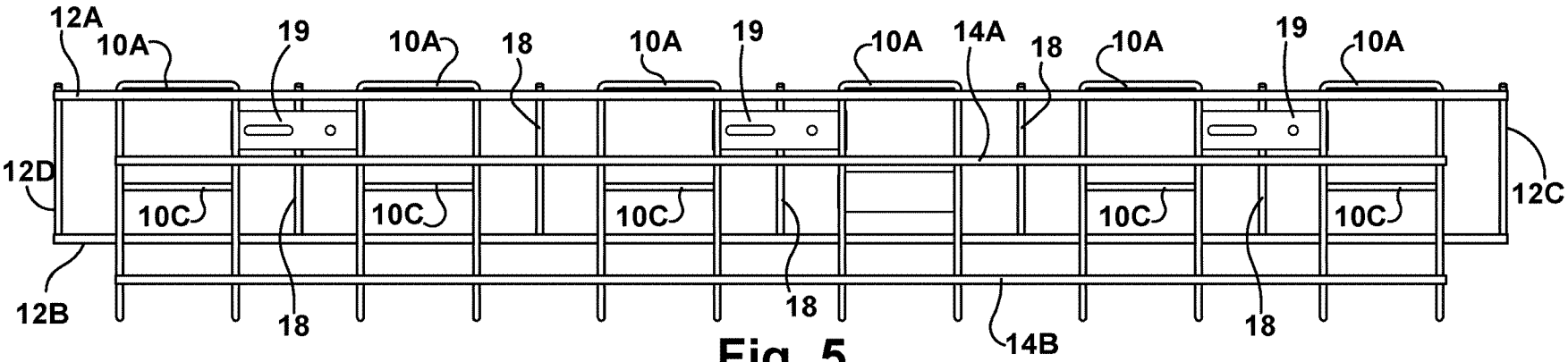
FIG. 5 is a rear view of the greeting card display assembly of FIG. 2.
Figure 6:
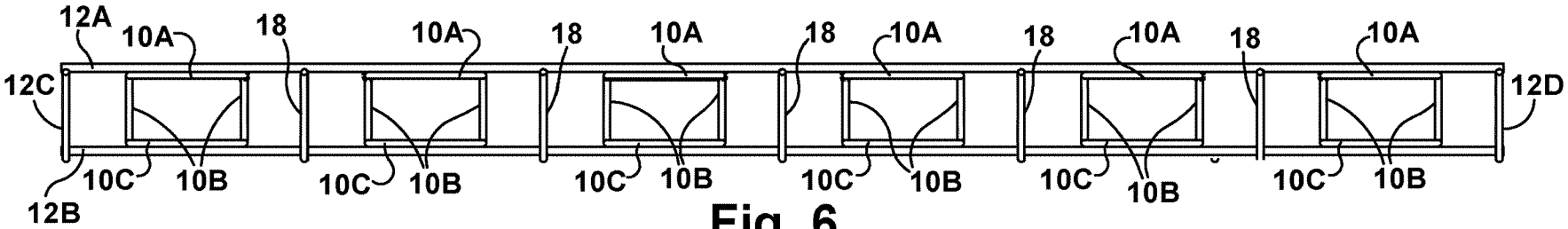
FIG. 6 is a top down view of the greeting card display assembly of FIG. 2.
Figure 7:
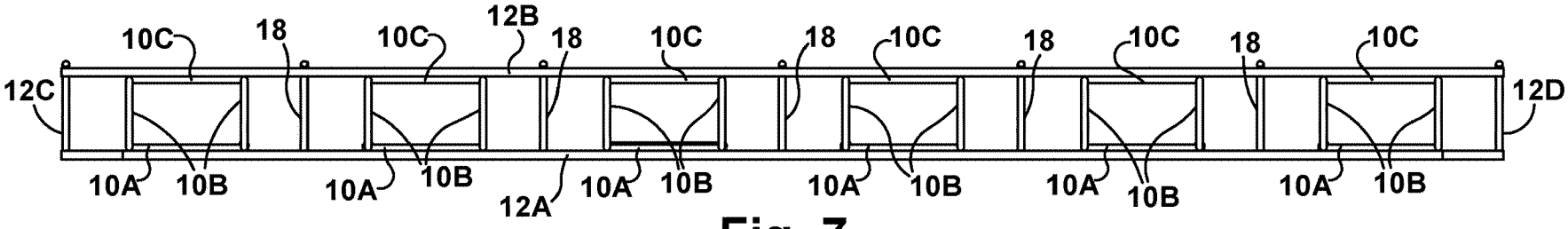
FIG. 7 is a bottom up view of the greeting card display assembly of FIG. 2.
Figure 8:
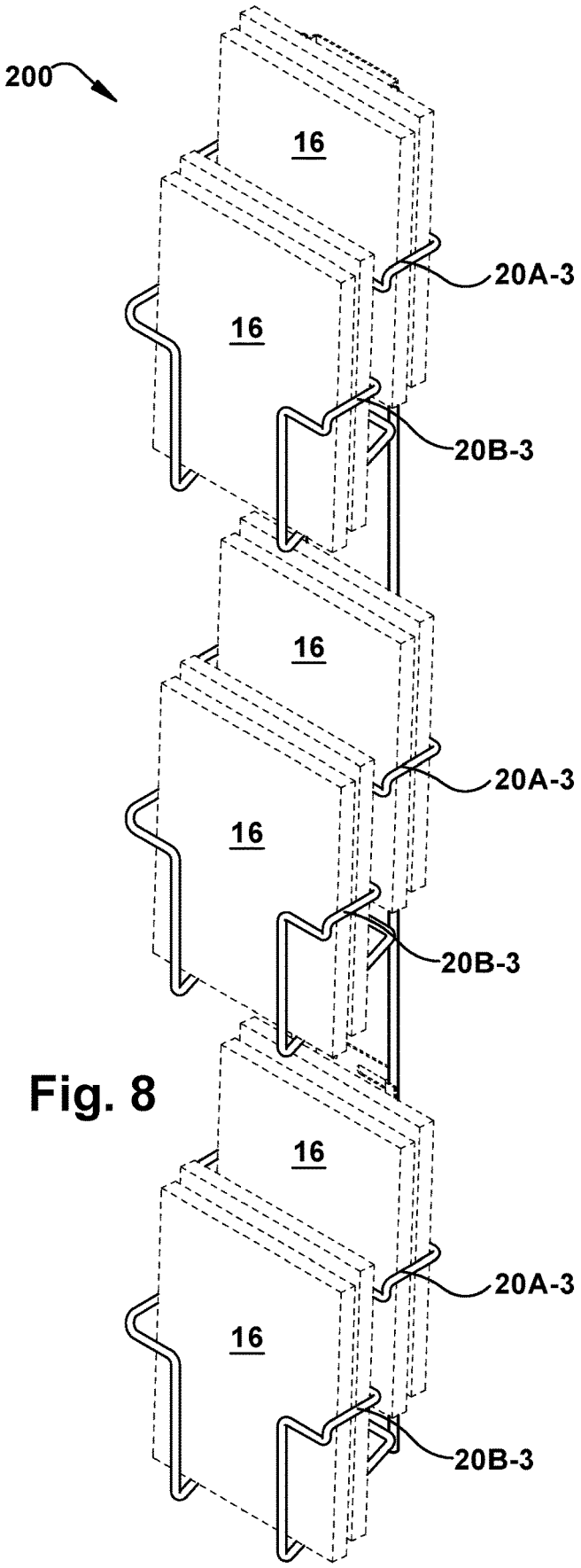
FIG. 8 is a perspective view of a second embodiment of the greeting card display assembly of the present invention, with greeting cards contained therein.
Figure 9:
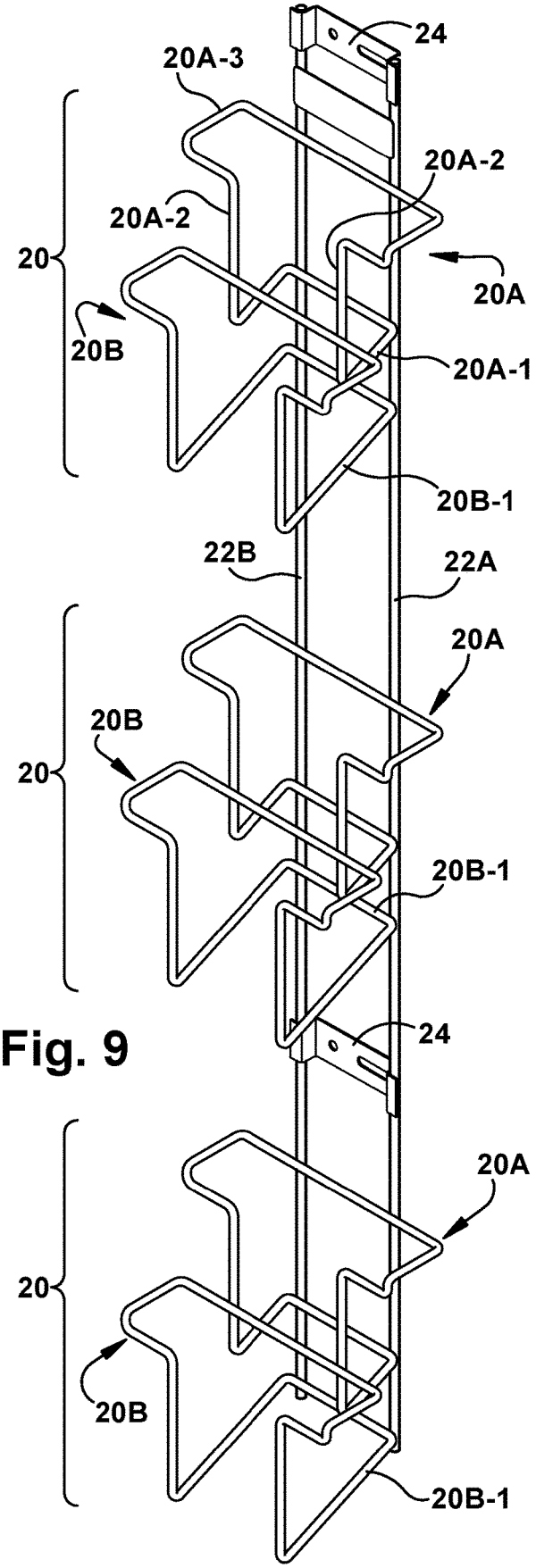
FIG. 9 is a perspective view of the greeting card display assembly of FIG. 8, without greeting cards.
Figure 10:
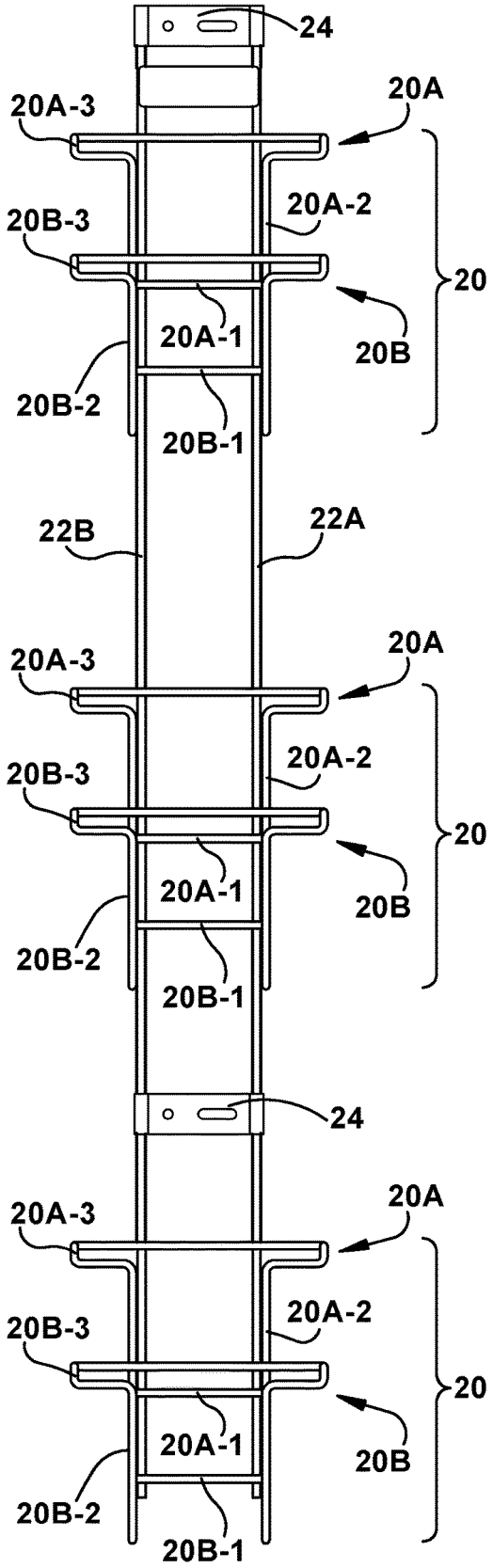
FIG. 10 is a front view of the greeting card display assembly of FIG. 9.
Figure 11:
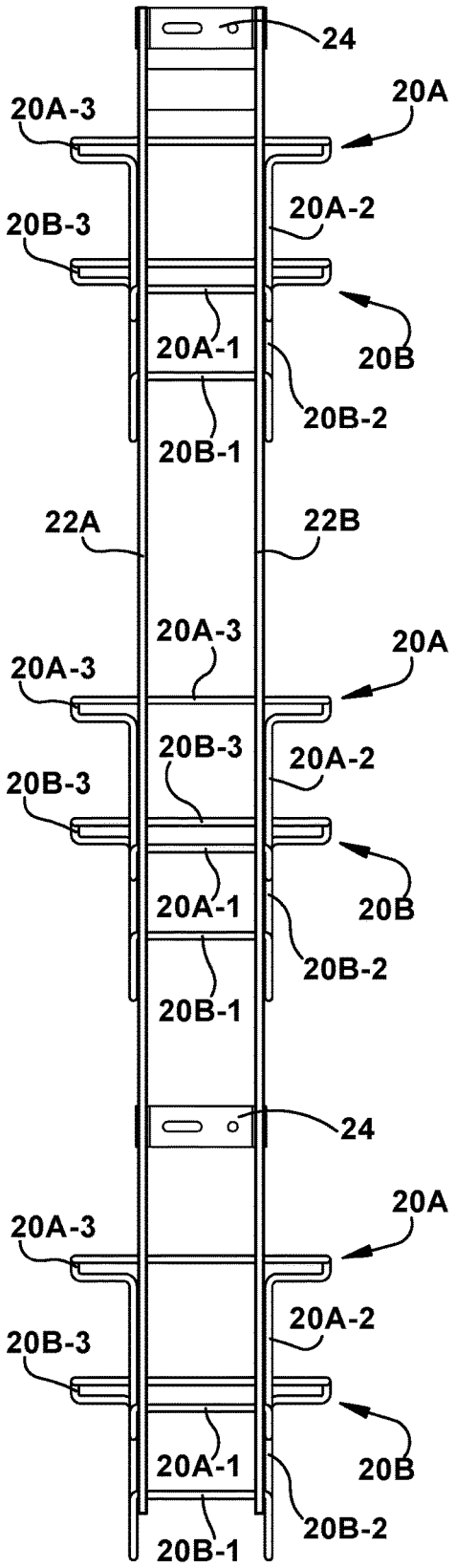
FIG. 11 is a rear view of the greeting card display assembly of FIG. 9.
Figure 12:
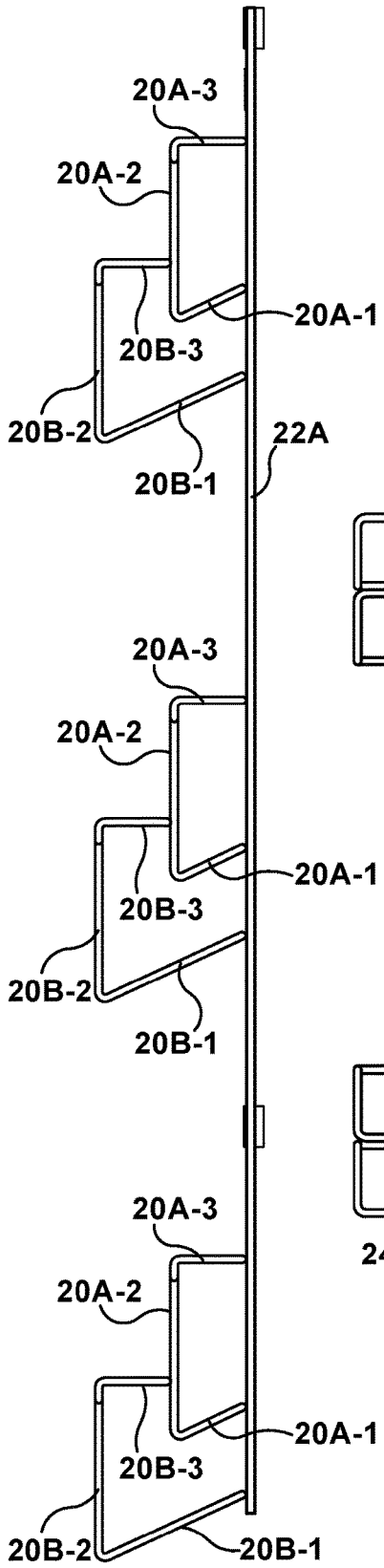
FIG. 12 is a right side view of the greeting card display assembly of FIG. 9.
Figure 13:
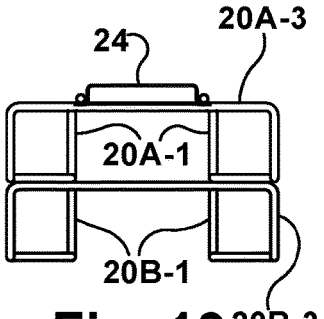
FIG. 13 is a top down view of the greeting card display assembly of FIG. 9.
Figure 14:
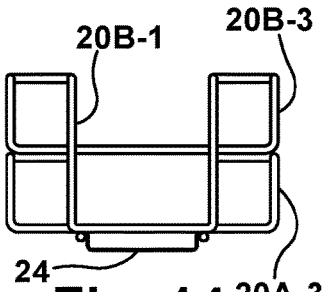
FIG. 14 is a bottom up view of the greeting card display assembly of FIG. 9.

A plurality of attachment plates 19 are attached to the greeting card display assembly 100 for attaching the greeting card display 100 to other surfaces. Each attachment plate 19 contains a single pre-drilled hole and a slot. An attachment plate 19 is placed between every other adjacent greeting card pocket 10. For example, if the greeting card display 100 contains 6 pockets, then an attachment plate 19 is placed (front left to right) between the first and second pockets, third and fourth pockets, and fifth and sixth pockets, as shown in FIG. 2. Each attachment plate 19 contains a small channel at each vertical edge that allows the attachment plate to be inserted over a portion of the wire formed greeting card pockets 10 and snap-fit into place.

As mentioned above, each attachment plate 19 contains one pre-drilled hole and one horizontal slot. These openings can accommodate various attachment mechanisms for attaching the display 100 to an existing surface. The greeting card display assembly 100 also includes various attachment mechanisms, including, but not limited to: hanger bracket; wing nut and lock washer; tree clip; wood screw; wall anchor; and zip ties. These attachment mechanisms allow the display 100 to be attached to various surfaces. For example, the hanger bracket, wing nut and washer can be used to hang the display 100 from end panels or a wall mount. Tree clips can be used to mount the display 100 to a pegboard panel. Wood screws and wall anchors can be used to mount the display 100 to solid panels. And the zip ties can be used to attach the display 100 to a wire grid. Of course, these attachment mechanisms and mounting surfaces are noted here for the purpose of example only. These attachment mechanisms can be used with other mounting surfaces. Also, other attachment mechanisms can be included.

In a second embodiment, shown in FIGS. 8 through 14, the greeting card display 200 of the present disclosure and related inventions, is a steel wire-formed construction creating a vertical row of greeting card pockets 20. A vertical wire support or spine 22, which runs the length of the vertically arranged card pockets 20, includes 2 parallel, spaced apart vertical wires 22A, 22B. A plurality of wire formed pockets 20 are attached to the support or spine 22. As shown in FIGS. 8 through 12, one example includes three sets of two tiered greeting card pockets 20 for a total of 6 pockets 20. Each pair of tiered greeting card pockets 20 contains a first or upper pocket 20A, made of a single wire, which includes an inverted u-shaped base 20A-1 which extends upward at each end to form two vertically arranged wires 20A-2 which serve as the front of the greeting card pocket 20. The two vertically arranged wires are perpendicular to the base 20A-1 at one end, and at the other end extend outward in opposing directions to form a backwards c-shaped mouth 20A-3 which provides a backing for the greeting cards 16 placed therein and also forms two sides to contain greeting cards 16 placed therein. A second or lower pocket 20B is shaped similarly to the first or upper pocket 20A, however, the second or lower pocket 20B contains a longer base 20B-1. The base portion 20A-1, 20B-1 of both the first and second card pockets 20A, 20B is attached to the wire support or spine 22. Both base portions 20A-1, 20B-1 are positioned in a forward sloped arrangement, with the second or lower pocket 20B forming a steeper slope than the first or upper card pocket 20A. The backwards c-shaped mouth 20B-3 of the second or lower card pocket 20B is attached to the front of the first or upper card pocket 20A as shown in the FIG. 9. Each pair of tiered greeting card pockets 20 are spaced apart along the wire support or spine 22, with a first set of 2 pockets 20 in an upper region of the display 200, a second set of 2 pockets 20 in a middle region of the display 200 and a third set of 2 pockets 20 in a lower region of the display 200. In the embodiment shown in FIGS. 8 through 14, the length of the vertical greeting card display 200 is approximately 39.875 inches with a width of approximately 6 inches. Each pocket 20 has a depth of 1.5 inches. The tiered pockets 20 are spaced apart such that a substantial portion of the greeting cards 16 placed into the first or upper pocket 20A can be seen above the greeting cards 16 placed into the second or lower pocket 20B. Two attachment plates 24 are attached between the two wires 22A, 22B of the wire support or spine 22. One attachment plate 24 is located at the very top of the vertical display 200 and a second attachment plate 24 is located between the second and third pairs of tiered card pockets. Each attachment plate 24 contains one pre-drilled hole and one horizontal slot for accommodating various attachment mechanisms, as discussed above with respect to the first embodiment 100, as described above.

The greeting card display assembly 100, 200 of the present disclosure and related inventions provides a flexible fixture from which to display greeting cards 16 in various locations within a retail environment. The flexible attachment plates 19, 24 and various attachment mechanisms allow for the attachment of the display 100, 200 to a variety of surfaces. The rugged construction of the steel wire can provide years of service as it is durable and strong, however, it is also lightweight so that it can easily be installed and moved to other locations, as required. The relatively small footprint also makes it ideal for space-conscious store layouts. For example, the greeting card display 100, 200 may be attached to or around the cash wrap or register where many last minute or impulse buys are made.

While the greeting card display assembly of the present disclosure and related inventions is described herein with respect to the embodiments shown in the figures, other similar arrangements are considered to be within the scope of this invention. For example, in the embodiments shown in the figures, the greeting card display assembly contains six greeting card pockets, however, less than six and greater than six pockets is considered to fall within the scope of this invention. The greeting card display assembly has also been described as being wire formed, however, other materials have been contemplated and are also considered to fall within the scope of this invention.

The foregoing embodiments of the present invention have been presented for the purposes of illustration and description. These descriptions and embodiments are not intended to be exhaustive or to limit the invention to the precise form disclosed, and obviously many modifications and variations are possible in light of the above disclosure. The embodiments were chosen and described in order to best explain the principle of the invention and its practical applications to thereby enable others skilled in the art to best utilize the invention in its various embodiments and with various modifications as are suited to the particular use contemplated.

The invention claimed is:

1. A greeting card display comprising:

a wire frame, having two horizontally positioned long sides which are parallel to each other, and two vertically arranged short sides which are parallel to each other and perpendicular to and extend between the two horizontally positioned long sides;

a wire support or spine;

a plurality of greeting card pockets, having an inverted u-shaped back portion, two parallel center wires which extend perpendicular to and outward from the back portion, and an inverted u-shaped front portion which is perpendicular to and extends upward from the two parallel center wires and parallel to the back portion;

one or more attachment plates attached to two of the plurality of greeting card pockets, the one or more attachment plates configured to accommodate various attachment mechanisms including hanger brackets, tree clips, wood screws, wall anchors, wing nut and lock washers and zip ties;

wherein a height of the front portion of each of the plurality of greeting card pockets is greater than half of a height of the back portion of each of the plurality of greeting card pockets;

wherein the back portion of each of the plurality of greeting card pockets is attached to one of the horizontally positioned long sides of the wire frame and the front portion of each of the plurality of greeting card pockets is attached to another of the horizontally positioned long sides of the wire frame; and wherein the wire support or spine runs along a backside of the back portion of each of the plurality of greeting card pockets.

2. The greeting card display of claim 1, wherein the plurality of greeting card pockets are arranged in a horizontal manner.

3. The greeting card display of claim 1 further comprising a plurality of divider wires located between each pair of adjacent greeting card pockets.

* * * * *